United States Patent [19]

Eriksson et al.

[11] Patent Number: 4,686,801

[45] Date of Patent: Aug. 18, 1987

[54] ROOF STRUCTURE

[75] Inventors: Lars Eriksson, Port Hope, Canada; Brian V. Knight, New Hartford, N.Y.

[73] Assignee: Orfus Limited, Freeport, The Bahamas

[21] Appl. No.: 891,474

[22] Filed: Jul. 29, 1986

[51] Int. Cl.[4] ..... E04B 1/32

[52] U.S. Cl. ..... 52/81; 52/82

[58] Field of Search ..... 52/80, 81, 82

[56] References Cited

U.S. PATENT DOCUMENTS

| | | | |
|---|---|---|---|
| 2,223,418 | 12/1940 | Hewett | 52/81 |
| 3,921,555 | 11/1975 | Suzuki | 52/80 |
| 4,230,255 | 10/1980 | Couter | 52/80 |
| 4,285,174 | 8/1981 | Knight | 52/82 |

FOREIGN PATENT DOCUMENTS

| | | | |
|---|---|---|---|
| 744895 | 10/1966 | Canada | 52/81 |
| 1438883 | 4/1966 | France | 52/82 |
| 8503321 | 8/1985 | World Int. Prop. O. | 52/82 |

*Primary Examiner*—Henry E. Raduazo

*Attorney, Agent, or Firm*—D. Peter Hochberg

[57] ABSTRACT

A self supporting roof structure comprises a plurality of vertically adjacent circular upwardly inwardly inclining at least partial rings stacked one on another. Each ring comprises a plurality of like horizontally adjacent panels each of which is an aliquot of the ring. Each panel comprises an outer surface which is convex from side to side, upwardly converging rectilinear sides, a concave top plate member, and a convex bottom plate member. The top and bottom plate members in each ring conform to respective upper and lower inwardly downwardly sloping conical surfaces of which the apex coincides with the axis of the roof structure. Preferably, at least one ring has a number of panels which is an integral number greater than one times the number of panels of the ring above. The roof has each panel disposed with its sides laterally staggered with respect to the sides of the panels in the rings above and below, thus avoiding lines of vertical weakness, and may be formed from panels which fall within a narrow range of sizes.

13 Claims, 11 Drawing Figures

ROOF STRUCTURE

The present invention relates to a self supporting roof structure of circular or part circular plan, that may be erected upon a base or wall to become a building with a multitude of uses, for example, an agricultural building such as a barn, silo and the like, a storage building for granular material, bulk or prebagged, or a place of assembly such as an arena or restaurant.

Various building structures that diminish in size from bottom to top have been proposed. One of these is shown in Heiber Canadian Pat. No. 744,895 issued October 25, 1966 wherein a dome of generally spherical shape is constructed of relatively heavy rings stacked one upon another, the rings being formed of panels which are said to be planar. Another is shown in Fitzpatrick U.S. Pat. No. 3,820,392 issued June 28, 1974 wherein flat panels are assembled to provide a multifaceted building. Another is shown in Knight U.S. Pat. No. 4,285,174 issued August 25, 1981 also using flat panels. The prior proposals of which applicant is aware have, however, resulted in structures which are not as completely stable as may in some cases be desirable.

The present invention provides a self supporting roof structure comprising a plurality of vertically adjacent circular upwardly inwardly inclining at least partial rings stacked one on another; each ring comprising a plurality of like horizontally adjacent panels each of which is an aliquot of the ring; each panel comprising an outer surface which is convex from side to side, upwardly converging rectilinear sides, a concave top plate member, and a convex bottom plate member; top and bottom plate members in each ring conforming to respective upper and lower inwardly downwardly sloping conical surfaces of which the apex coincides with the axis of the roof structure; and each panel being disposed with its sides laterally staggered with respect to the sides of the panels in the rings above and below.

With this arrangement since the vertical joints between adjacent panels are staggered with respect to the panels in adjacent rings, the top plate members of one ring together with the bottom plate members of the ring above form a structural ring or partial ring beam, providing the structure with excellent stability. Further, vertical lines of weakness are avoided.

With the prior proposals of which applicant is aware, there are practical limits on the size of the roof that can be built. With the arrangement in the Heiber Canadian patent above referred to, for example, each pre-assembled ring, consisting of an upper circular beam, a plurality of stiffening ribs extending outwardly downwardly therefrom, and a member of sheet segments connected on the outer sides of the beam and ribs, and forming a depending conical skirt thereon, is lifted with a crane and placed on the preceding, large diameter ring with the lower ends of the ribs abutting the upper side of the beam of the preceding ring. There are limits on the diameter and on the weight of the rings that can be lifted using conventional lifting equipment.

With the prior proposals in the above-mentioned Fitzpatrick and Knight patents, the domed roof structure consists of a plurality of generally triangular segmentsextending from the base to the top of the roof, and each consisting of a large trapezoidal panel at the base, and each successive trapezoidal panel stacked thereon becoming progressively smaller toward the top. In theory, a large diameter dome can be built using a large number of such segments side by side. However, assuming the structure is to have a height commensurate with its diameter, the upper panels in each segment would become of such small size that the fabrication of the large number of them needed to complete the dome would become impracticably time-consuming, and expensive.

In the preferred form, at least one ring of the structure comprises a number of panels which is an integral number greater than one times the number of panels of the ring above. With this arrangement, since the ring above said one ring is composed of panels which are an integral multiple of, for example two or three times, the width of the panels in the preceding, said one ring, it is possible to build structures of considerable height without the upper panels becoming excessively small and without requiring the use of an initial ring of panels, at the base of the structure, composed of panels of excessively large width.

As a result, the structure is readily adapted to be constructed of panels manufactured from lumber materials, for example plates, sheets and boards or battens, of standard dimensions, although they can with advantage be manufactured from materials such as glass fibre reinforced plastics or metal.

The roof structure may be of full circular plan or may be of partially circular plan, for example semi-circular, and may be of generally arcuate domed profile, or may be conical.

The invention will now be described by way of example only with reference to the accompanying drawings in which.

Figure 1:
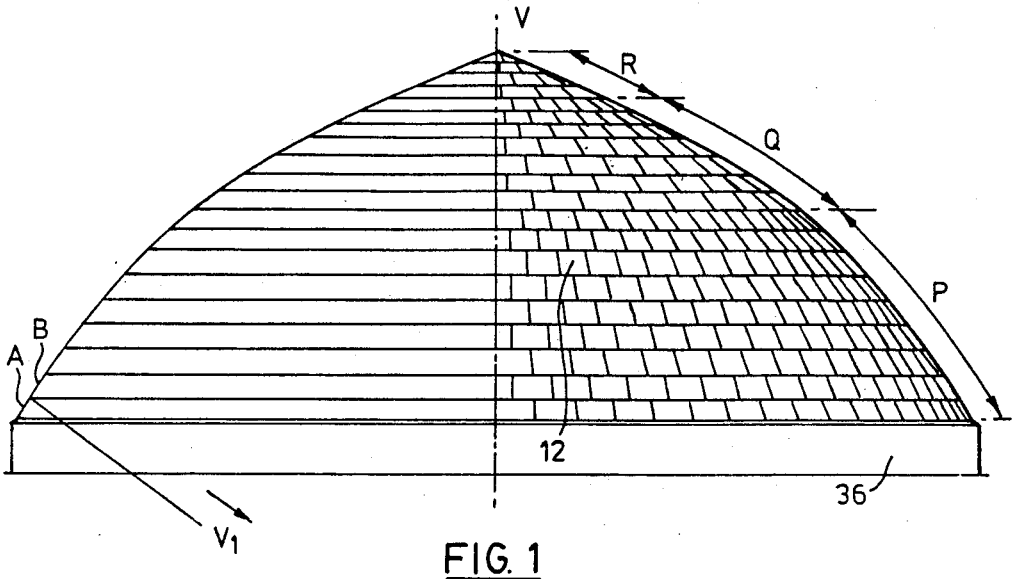
FIGS. 1 and 2 show a side elevation and partial or half plan view, respectively, of a large diameter domed roof structure.
Figure 2:
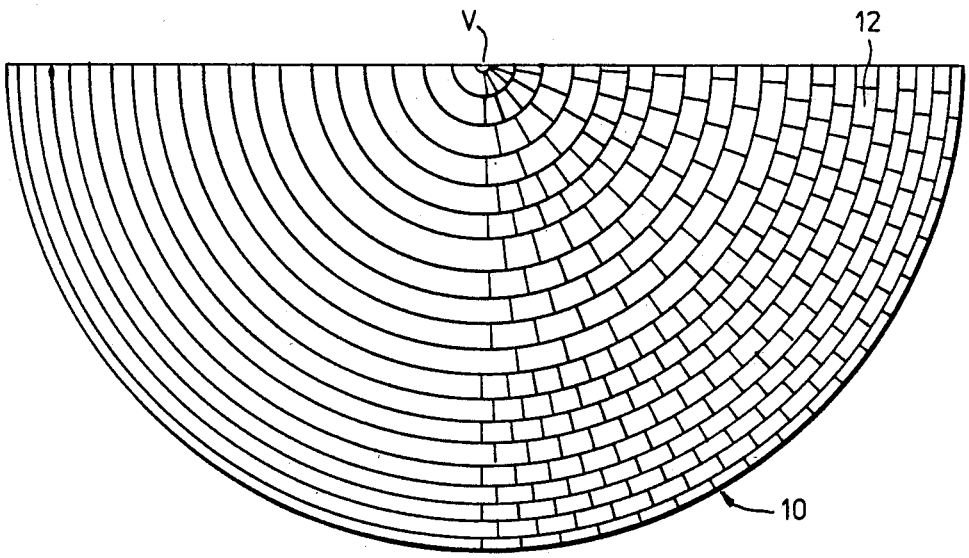

Referring to FIGS. 1 and 2, wherein only the right hand halves of the Figures show the structure of the dome in detail, the dome 10 is composed of a plurality of rings each conforming closely to a frustum of a cone and each inclining upwardly and inwardly at a progressively more pronounced angle of inward inclination toward the top.

Figure 6:
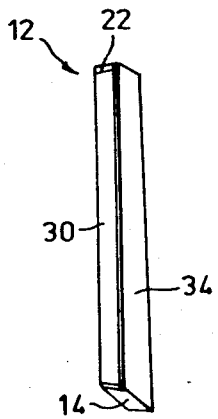
FIGS. 4, 5 and 6 show inside elevational; top and side view of a typical panel.
Figure 5:
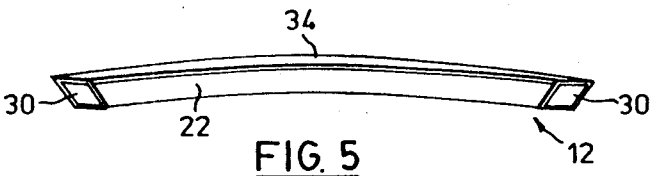
Figure 4:
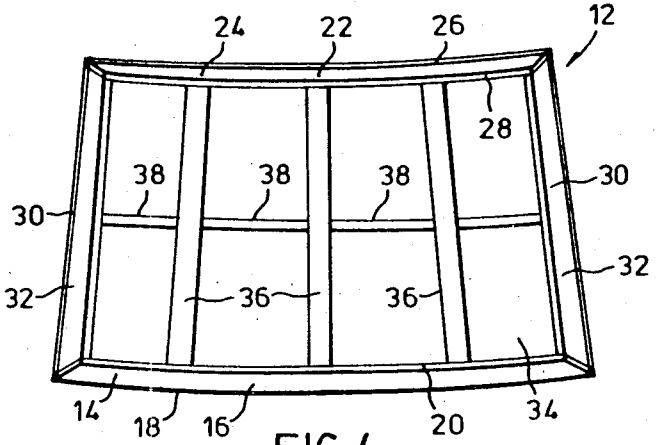

FIGS. 4 to 6 show the structure of a typical panel. For the sake of clarity of description, a lumber material panel 12 will be described in detail, although it will be appreciated that the same or an equivalent panel could readily be manufactured and used made from an assembly of glass fibre reinforced plastic materials or metal sheeting, plates and tubular pieces, for example metal extrusions.

The panel comprises a bowed bottom plate member 14 having a convex lower surface 16, a forwardly convexly profiled front edge 18 and a concave rear edge 20.

A top plate member 22 is bowed almost parallel to the bottom plate and comprises a concave upper surface 24, a forwardly convexly profiled front edge 26 and a concave rear edge 28.

The top member 22 is shorter in length than the bottom member 14, depending on the angle of inward inclination it is intended to achieve for the frustum and hence on the difference in circumference between the lower and upper edges of the frustum. Hence sides members 30, which are rectilinear, converge inwardly upwardly. The members 30 are disposed so that their outer sides 32 extend radially and thus abut the side members of adjacent panels snugly when a plurality of the panels are assembled side by side to form a ring. The upper and lower ends of each side member 30 are machined to conform to the inner surfaces of the ends of the top and bottom members 22 and 14, respectively.

A sheet 34, for example of plywood, is bent into an outwardly convex curvature to conform to the front edges of the bottom and top members 14 and 22 and of the side members 30, and the whole is held together by mechanically fastening together adjoining parts, for example by nailing, and/or by glueing. Usually, the front edges of the members 14 and 22 are machined to conform to the angle between them and the sheet 34, as seen in profile in FIGS. 8 and 9.

In manufacturing the panels employed in each ring, the dimensions and shapes of the elements of the panel, including the sheet 34, the top and bottom members 22 and 14, and the side members 30 are selected depending on the position of the ring in the structure, and with a view to achieving a structure of the required strength and stability and to minimizing wastage of the materials employed. Usually, the panels will be manufactured or prefabricated off-site and transported to the site where the roof structure is to be erected.

In the example shown in FIGS. 1 and 2, a lowermost ring A rests on a vertical wall 36, e.g. of reinforced concrete. The upper annular edge of the wall 36 inclines inwardly downwardly and conforms to a shallow inverted cone having its apex coincident with the vertical axis V of the structure. Cast-in-place studs or other anchors may be spaced uniformly around the circumference of the upper edge of the wall 36 to pass through holes drilled through the bottom members 14 of the lowermost ring A or tier of panels to be placed thereon, nuts then being threaded onto the studs to engage the upper side of plate member 14 and secure the panels in place. The wall 36 receives a downward and outward thrust imposed by the weight of the rings stacked thereon, and the angle of inward inclination of the top edge of the wall 36 is selected so that the wall 36 stably receives this thrust. In the course of design of the roof and manufacture of the panels, desired angles of inward inclination of the bottom ring A of panels and of each other ring are selected. The inclination desired for the successive rings may depend on, for example, the angle of repose of a bulk granular or particulate material to be stored under the roof structure. From the above-mentioned angles, as will be appreciated, the required angle between the sheet 34 and the bottom member 14 for the panels of the bottom ring A can be calculated.

The dimensions of the sheet 34 for each panel of the ring A are then selected, in order to conform to, as far as possible, the size of the largest sheets of standard size plywood or other sheet material available. This then determines the lengths of bottom member 14 and of the side members 30, and the number of like or identical aliquot panels needed to complete the ring. It also allows calculation of the angle at which the side members 30 should be inclined to one another so that their outer sides 32 extend radially in the ring. From the angle of inward inclination of the ring and the number of aliquot panels to be used, the required length of the top member 22 of each panel can be calculated.

Figure 8:
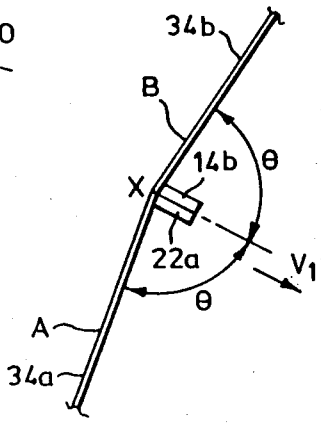
FIGS. 8 and 9 are cross sectional views through the top and bottom plate members of adjacent panels at lower and upper positions, respectively, in the dome.
Figure 9:
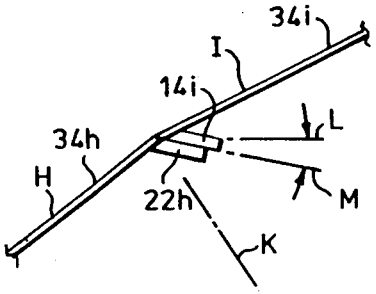

The angle of the top member 22 relative to the horizontal and hence also its angle relative to the sheet 34 are preferably determined with reference to the desired angle of inward inclination of the next upwardly adjacent ring B of the structure. Referring to FIG. 8, which shows a cross section through rings A and B, the top members **22*a* of the panels forming the ring A and the bottom members 14*b* of the panels forming the ring B, at any cross section preferably bisect the interior angle $2\theta$ formed between the sheets 34*a* and 34*b*** of the said panels.

Thus, having selected an angle of inward inclination of the next upwardly adjacent ring B, the angle $\theta$ of the top member **22*a* relative to the sheet 34*a* of the panels of the lower ring can be calculated. The same calculation will also give the angle $\theta$ of inclination of the bottom member, e.g. the member 14*b*, relative to the sheet 34*b*** of the panels of ring B.

As will be appreciated therefore, the required shapes and dimensions of all the elements of the panel of the lowermost ring are to be arrived at by calculation. Further, assuming that the next ring is to contain the same number of panels, i.e. that the lengths of the top members **22*a* of the panels of the lowermost ring A are to be the same as the lengths of the bottom members 14*b* of the next upwardly adjacent ring of panels B, a similar series of calculations can be made, commencing with the abovementioned angle $\theta$ between the member 14*b* and the sheet 34*b***, to obtain the required shapes and dimensions for the latter panels. Such calculations can then be repeated for each successive ring up the profile of the dome.

In manufacturing the pieces which form the bottom and top plate members 14 and 22 from rectangular plates of lumber, the starting material plates have to be cut along arcuate lines extending generally longitudinally of the front and rear longitudinal edges of the plate and then the ends of the plates need to be bent upwardly relative to the middle so that the plate member has imparted to it a bowed configuration. As will be appreciated, such members when fitted together end to end, will form a narrow dished annulus conforming to an inverted cone having its apex at the vertical axis V of the roof structure. In the case of the lower plate member of the lowermost ring A, such dished annulus conforms to the annular upper surface of the wall 36, so that the panels of the ring A seat snugly on the wall. In the case of the top member **22*a* of the panels of the ring A and the bottom member 14*b* of the panels of the ring B, these form mating dished narrow annuli of a diameter and angle of inward inclination desired so that the lower edge of ring B, formed by the adjacent members 14*b* will seat snugly on the upper side of the upper edge of ring A, formed by the adjacent members 22*a*. As noted above in the preferred form, the members 14*b* and 22*a* form equal angles $\theta$ with their respective sheets 34*b* and 34*a*. Thus, referring to FIG. 7 which shows a structure different in some respects from that of FIGS. 1 and 2, but which will illustrate the principle, the bottom members of the ring B, and the top members of the ring A, corresponding to the members 14*b* and 22*a*, will conform to a narrow dished outer annular margin of a cone formed by sweeping a generator line X $V_1$ around the axis V, and the outer convex edges of these members will conform to the circular edge of this cone. Employing the well-known principles of geometry and trigonometry, and given the dimension and angle of the upper edge of the wall, the angle of inward inclination of each successive ring, the number of panels in each ring, and the desired angle between each bowed lower plate member 14 and its sheet 34 and between each bowed upper plate member and its sheet 34, one can readily calculate the dimensions of each plate member 14 or 22** in the panels of each ring, the profile to which the front edge of the starting material lumber plate is to be cut and the distance by which the ends of the plate are to be bent upwardly to arrive at the required bowed and forwardly convexly profiled configuration. The nature of such calculations will be familiar to those skilled in the art and need not be discussed in detail herein.

Figure 10:
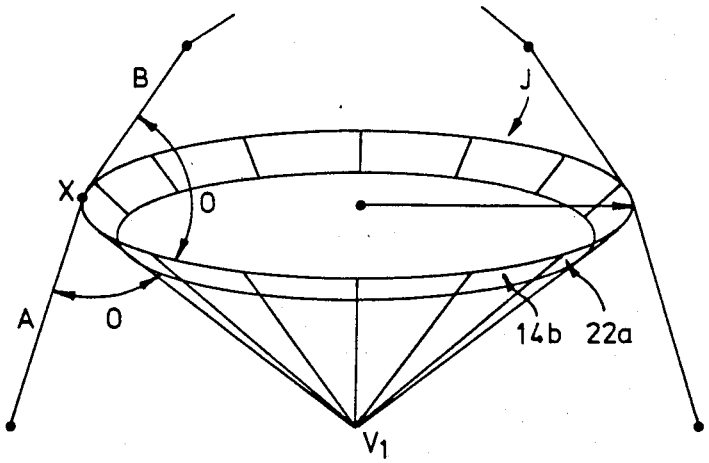
FIGS. 10 and 11 are somewhat schematic and illustrate the construction of and principles employed in the manufacture of elements of the panels of the dome.
Figure 11:
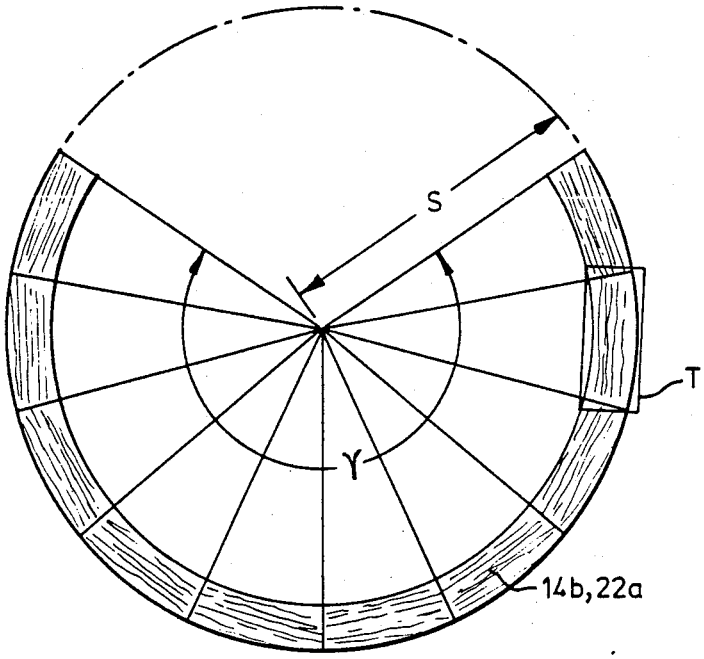

By way of brief illustration, however, FIG. 10 shows schematically a cross-section through the rings A and B. Assuming for the moment members 22*a* and 14*b* have no thickness, they correspond to a narrow annular margin J of the inverted cone generated by rotation of $V_1X$. Imagining this cone is made of paper, it can be cut along the generator $V_1X$ and then flattened out to form a major sector of circle as shown in FIG. 11, of radius $S=V_1X$ and subtending an angle $\gamma$. It is believed that it will be readily seen from the above that it is readily possible to calculate the dimensions of the plates 14*b*, 22*a*, allowing them to be cut from, for example, a rectangular plate T shown in FIG. 11, and the distances by which their ends have to be bent up to conform to the inverted cone. In such calculations allowance needs to be made for the fact that the plates have a certain thickness.

As will be appreciated, the required repetitive calculations are well adapted to be performed using a computer program.

It may be mentioned that the reason that it is preferred to have the members 14 and 22 bisect, in profile, the angles between the adjacent rings is that this reduces wastage in cutting the lumber since with this arrangement, the displacement of the cutting line laterally inwardly from the front edge near and at the ends of the lumber plate T is less than is the case when plate is to be conformed to a cone having its side inclined at an angle departing from the bisecting angle.

The rear edge of the lumber plate need not be but preferably is cut concavely to provide the concave rear edges 20 or 26, so that the finished member does not protrude into the space within the dome and so that the width of the member is reduced and the member is thus rendered somewhat easier to bend.

In the preferred form, the rings constituting the dome are arranged in sets of contiguous rings, each consisting of rings containing like members of panels, but different sets having rings containing different numbers of panels. More particularly, at the transition from one set of rings to the next, the upper ring of the lower set preferably contains an integral multiple of the number of panels in the lowermost ring of the upper set. Desirably this multiple is two, i.e. the number of panels doubles from the upper set to the lower set, to avoid major discrepancies between the sizes of the panels which would give rise to problems of efficient utilization of the standard size sheet materials.

For example referring to FIG. 1, the domed roof 10 consists of a first set of rings P, each of which contains the same number of panels, a second set Q consisting of rings each of which contains exactly half the number of panels contained in the rings of set P, and a third set R, consisting of rings containing half the panel number of the rings of set Q.

As will be appreciated the above-mentioned calculations employed to derive the dimensions and curvatures of the elements of the panels in the successive rings can be readily modified to take into account the transition from one set to the next. It is merely necessary to select a number of panels for the initial ring in a new set to be, for example, half that of the preceding ring. This arrangement allows the panels to be staggered with respect to panels in the rings immediately above and below, so that at no point in the structure is a vertical joint between adjacent panels aligned with a vertical joint in the ring above or below, so that vertical lines of weakness in the structure are avoided, and allows the fabrication of large dome structures using throughout panels of sizes which fall within a narrow range, thus greatly facilitating the manufacture, handling and transportation of the panels.

As seen in FIG. 1, where the length of the bottom plate member 14 of a panel is made the same as or an integral multiple of that of the top plate member 22 of the preceding ring, it is possible to arrange each panel so that its edges are displaced or offset relative to the panels above and below, for example so that its edges bisect the panel below. This is facilitated by the seating of each panel on its neighbour immediately below through the conically curved mating plate members 14 and 22, which in effect permit each ring to be disposed at any desired angular position relative to the ring beneath. However, this arrangement necessarily results in the width of each panel becoming progressively smaller up the profile of the roof. In the design and fabrication of the structure, at a point where the width of a panel would become undesirably small a ring is employed such that the ring below has an integer (greater than one) times the number of panels so that wide variation in the sizes of the panels can be avoided. Preferably, in order to reduce the range of distribution of sizes of the panels, the said integer is two, but it will be appreciated that it would be possible to employ arrangement in which the integral multiple is three or more, although with less advantage.

Further, it will be appreciated that the range of distribution of the sizes of the panels can be confined by employing other arrangements wherein at least one ring has a number of panels which is an integer (greater than one) times the number of panels of the ring above. For example, where there is a limited supply of large size sheet material and large size plates available it may be advantageous in a given case to employ a second ring consisting of half the number of panels of a first or lower ring and then to employ a third ring consisting of twice the number of panels in the second ring. More usually, however, and more advantageously in most cases, the number of panels in each ring is an integer, usually one or two, multiplied by the number of panels in the ring above.

Figure 3:
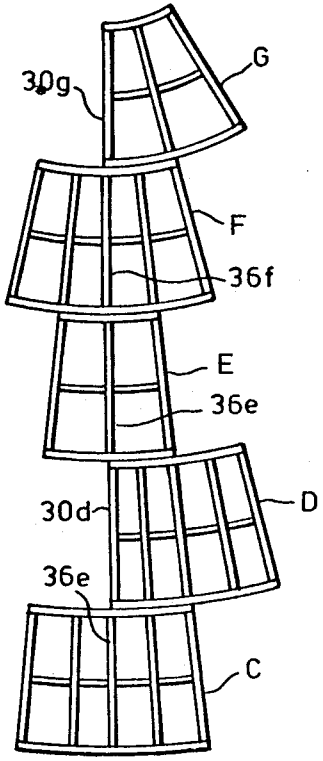
FIG. 3 shows a partial elevation of a series of vertically-adjacent panels forming part of the structure, seen from the inside.

Referring to FIGS. 3 to 6, in the preferred form each panel comprises a series of regularly laterally spaced reinforcing ribs 36 which may be rectilinear lumber pieces fastened and/or bonded to the inner side of the sheet 34 and having their ends machined and connected to the inner sides of the bottom and top plate members 14 and 22. The ribs 36 are disposed so that each side member 30 of each panel is aligned with a reinforcing rib 36 of a panel in the ring below, for example as seen for the panels of rings indicated as C to G, wherein it will be noted there is a transition between rings E and F resulting in a halving in the number of panels. As a result the aligned ribs and side members form vertically extending reinforcing struts or supports greatly enhancing the strength and stability of the structure. Where, as seen in FIG. 3, the edges of each panel bisect a panel beneath, for example, the reinforcing ribs may be positioned so as to include a rib disposed centrally of the panel.

As seen in FIGS. 4 and 6, the panels may also be provided with horizontal braces 38 comprising rectilinear pieces of lumber connected between adjacent ribs 36 and between the ribs 36 and the side members 30. The braces may be rectilinear and preferably are machined to conform to the curvature of the sheet 34.

Figure 7:
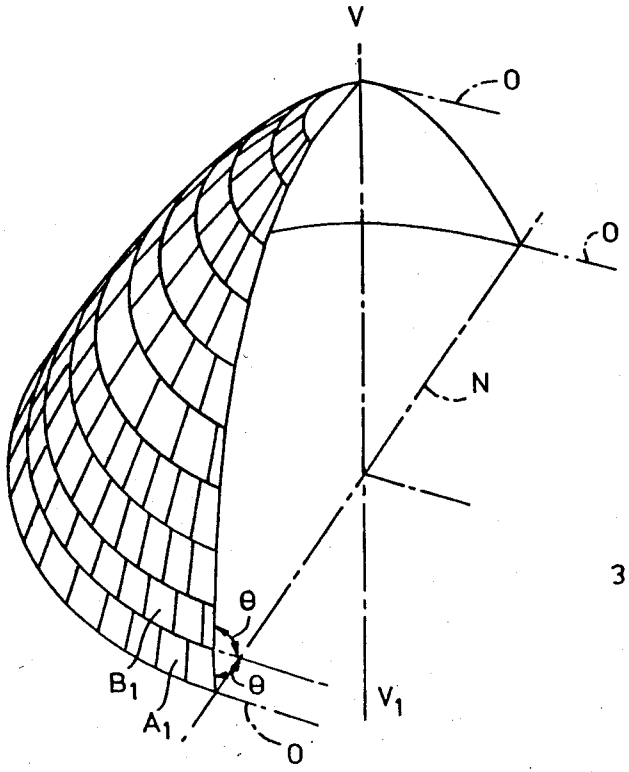
FIG. 7 is a perspective view of a semicircular dome.

As may be appreciated by reference to FIG. 7, with rings higher up the dome, the cut plate members have to be bent increasingly sharply, since the base of the above mentioned inverted cone decreases and its side becomes more steeply downwardly inclined. Since there is a minimum radius of curvature to which wood can be bent without splitting, it is advantageous with rings at least at upper regions of the dome, to employ plate members 14 and 22 which are bent less sharply. This can be achieved by employing plate members which are arranged so that they conform to conical surfaces extending at an angle displaced toward the horizontal from the angle which bisects the angle between the adjacent rings. For example with reference to FIG. 9, K represents the line bisecting the angle between rings H and I. L represents the horizontal plane. M indicates the angle of the cone to which the plate members 14*i* and 22*h* of the panels of rings H and I conform, in order to alleviate the sharpness of the bending that needs to be applied to them.

In the course of construction of the dome, the usually prefabricated panels are placed in their predetermined positions, usually completing one full ring before commencing assembly of the next. The individual panels can be readily lifted into place using cranes or other conventional lifting equipment. The panels are usually secured together by fasteners e.g. nuts and bolts passed through openings predrilled in the side, top and bottom members 30, 22 and 14 and through the corresponding members of the adjoining panels. Once assembled, the reaction between the mating downwardly inwardly inclining top members 22 and bottom members 14 serves to positively locate each ring firmly on the ring beneath and a structure with excellent stability and strength characteristics is obtained.

Above the uppermost ring, a small circular hole remains and this may be closed with a plug which rests on the top member of the ring and has a circular protrusion fitting snugly downwardly into the opening and serving to locate the plug against lateral movement.

Door openings or the like may be provided by omitting panels and providing openings in the wall 36.

The roof structure need not be fully circular. FIG. 7 shows a part circular, in this case semi-circular, structure, resulting in a half dome. The opening at the side may be closed with a vertically planar wall coincident with the axis V along the broken line N and connecting at its edges to the ends of the semicircles formed by the successive half rings of the roof structure.

Alternatively, two opposing open-sided roof structures as shown in FIG. 7 may be constructed and connected by a barrel-shaped roof construction indicated in broken lines at O, to form an oval shaped enclosure.

Various other additions and modifications are possible. For example, if each successive ring or part ring is inclined at the same angle as the preceding ring, a roof structure which is conical or part conical is achieved.

Although above the use of panels formed from lumber materials has been described, it will be appreciated that the same or similar panels could equally be formed from alternative materials, for example plastics, such as glass fibre reinforced plastics, or metal.

The completed roof structure may be made weathertight, if necessary, by sealing its joints or, more preferably by applying shingling or other protective coatings.

We claim:

1. A self supporting roof structure comprising: a plurality of vertically-adjacent, upwardly and inwardly inclining, at least partial rings stacked one on another; each ring being generally circular and comprised of a plurality of horizontally-adjacent similar panels each of which is an aliquot of the ring; each panel having an outer surface which is convex from side to side, upwardly converging rectilinear sides, a concave top plate member, and a convex bottom plate member; said top and bottom plate members in each ring defining upper and lower conical surfaces which slope inwardly and downwardly wherein the apex of said conical surfaces coincides with the axis of the roof structure; and each panel being disposed with its sides laterally staggered with respect to the sides of the panels in the rings above and below.

2. A structure according to claim 1 wherein at least one ring comprises a number of panels which is an integral number greater than one times the number of panels of the ring above.

3. A structure according to claim 2 wherein each ring comprises a number of panels which is an integer multiplied by the number of panels in the ring above.

4. A structure according to claim 2 wherein the rings are arranged in contiguous sets of rings, each ring in a set comprising the same number of panels, and each ring of a set comprising a number of panels which is an integer number greater than one times the number of panels in the rings of the set thereabove.

5. A structure according to claim 4 wherein the length of the bottom plate member of each panel in the lowermost ring of each set is twice the length of the top plate of the panels therebeneath.

6. A structure according to claim 1 wherein the inner edges of the top and bottom plate members of each panel are concavely curved approximately parallel to the curvature of the outer surface of the panel.

7. A structure according to claim 1 wherein each panel comprises a plurality of regularly laterally spaced reinforcing ribs extending between the top and bottom plate members on the inner side of the panel.

8. A structure according to claim 7 wherein each side of each panel is aligned with a reinforcing rib of a panel in the ring immediately below.

9. A structure according to claim 1 wherein the angle of inclination of the top and bottom plates of adjacent rings when viewed in cross section, bisects the angle formed between said adjacent panels in at least a lower set of said rings.

10. A structure according to claim 9 wherein at least upper rings have said conical surfaces at an angle displaced toward the horizontal from said bisecting angle.

11. A structure according to claim 1 wherein each successive ring from the bottom is progressively more pronouncedly upwardly inwardly inclined.

12. A structure according to claim 1 wherein each panel is disposed so that its sides bisect the panels in the ring below.

13. A structure according to claim 1 wherein each ring inclines at the same angle, and said roof is substantially conical.

* * * * *